US008967729B1

(12) United States Patent
Farris et al.

(10) Patent No.: US 8,967,729 B1
(45) Date of Patent: Mar. 3, 2015

(54) TRIP HAZARD REMOVAL SYSTEM AND METHOD

(71) Applicants: Floyd Farris, Green Cove Springs, FL (US); Floyd Farris, Sr., Green Cove Springs, FL (US)

(72) Inventors: Floyd Farris, Green Cove Springs, FL (US); Floyd Farris, Sr., Green Cove Springs, FL (US)

(73) Assignee: Safe Sidewalks, Inc., Green Cove Springs, FL (US)

( * ) Notice: Subject to any disclaimer, the term of this patent is extended or adjusted under 35 U.S.C. 154(b) by 0 days.

(21) Appl. No.: 14/334,606

(22) Filed: Jul. 17, 2014

(51) Int. Cl.
*B28D 1/04* (2006.01)
*E01C 23/088* (2006.01)
*E01C 23/09* (2006.01)

(52) U.S. Cl.
CPC ..... *E01C 23/0885* (2013.01); *B28D 1/045* (2013.01); *Y10S 83/928* (2013.01); *E01C 23/0933* (2013.01)
USPC ..... 299/39.3; 299/41.1; 83/928

(58) Field of Classification Search
CPC .... B28D 1/044; B28D 1/045; E01C 23/0933; Y10S 83/928
USPC ..... 299/36.1, 39.1, 39.2, 39.3, 39.5, 41.1; 404/87; 125/13.03
See application file for complete search history.

(56) References Cited

U.S. PATENT DOCUMENTS

| | | | | | |
|---|---|---|---|---|---|
| 3,785,705 | A * | 1/1974 | Binger et al. | 299/75 |
| 4,294,046 | A * | 10/1981 | Damiano | 451/344 |
| 4,433,871 | A * | 2/1984 | Bertrand | 299/41.1 |
| 4,792,190 | A * | 12/1988 | Bertrand | 299/41.1 |
| 4,832,412 | A * | 5/1989 | Bertrand | 299/39.3 |
| 5,135,287 | A * | 8/1992 | Karnes | 299/39.3 |
| 5,605,381 | A * | 2/1997 | Schmoock et al. | 299/39.2 |
| 5,676,125 | A * | 10/1997 | Kelly et al. | 125/13.03 |
| 6,158,817 | A * | 12/2000 | Bertrand | 299/39.3 |
| 6,582,026 | B2 * | 6/2003 | Bertrand | 299/39.3 |
| 8,733,845 | B2 * | 5/2014 | Bollinger | 299/39.3 |
| 2011/0203565 | A1 * | 8/2011 | Hilsgen et al. | 125/13.03 |

* cited by examiner

*Primary Examiner* — David Bagnell
*Assistant Examiner* — Michael Goodwin
(74) *Attorney, Agent, or Firm* — Mark Young, P.A.

(57) ABSTRACT

A saw assembly controllably moves in a cutting plane defined by two orthogonal tracks of a gantry. The cutting plane is configured to intersect a trip hazard on a walkway. A vacuum port of a shroud connects to a dust-removal vacuum via a hose. The shroud includes a vertically moveable shield that moves along the ground. The gantry is mounted to a utility vehicle in a manner that allows deployment for use and stowing for storage and transportation.

10 Claims, 15 Drawing Sheets

TRIP HAZARD REMOVAL SYSTEM AND METHOD

FIELD OF THE INVENTION

This invention relates generally to trip hazards, and, more particularly, to a system and method for systematically cutting trip hazards from concrete surfaces.

BACKGROUND

The Americans with Disabilities Act (ADA) of 1990 defines a 'trip hazard' as any vertical change of over ¼ inch or more at any joint or crack. Since the ADA demands strict compliance, trip hazards represent a legal liability to businesses. Cities, school districts, hospitals, churches, shopping malls, universities, apartment complexes, and other large building owners have good reason to be extremely concerned with trip hazards, the risk of injury to pedestrians and the attendant liability exposure.

One prior method to remove trip hazards is replacement. The affected concrete is demolished, removed, and replaced with a level surface. Unfortunately, such approach is time-consuming, expensive and disruptive. The walkway is rendered unusable for considerable time. The cost of replacement greatly exceeds the cost of repair. In many cases, replacement yields considerable waste, as the concrete which was otherwise intact is demolished and discarded.

Other past efforts to remove trip hazards entail manually grinding or cutting the protruding trip hazard. While such efforts may be effective for removing a trip hazard, they tend to be time-consuming and inefficient, extremely imprecise, scattering considerable concrete dust, and resulting in uneven surfaces.

What is needed is a controlled saw-cutting system and methodology that completely and cleanly removes trip hazards from sidewalks and similar walkways, from edge to edge, providing a safe walkway and virtually eliminating claims that result from trips and falls on uneven sidewalk.

The invention is directed to overcoming one or more of the problems and solving one or more of the needs as set forth above.

SUMMARY OF THE INVENTION

To solve one or more of the problems set forth above, in an exemplary implementation of the invention, a saw assembly controllably moves in a cutting plane defined by two orthogonal axes. An exemplary saw assembly includes a circular toothed blade that is configured to cut concrete and similar materials. A motor, such as a hydraulic motor, rotatably drives the saw blade. An adjustable shroud substantially surrounds the blade and confines dust and debris. A vacuum port of the shroud connects to a dust-removal vacuum via a hose.

A gantry supports the saw assembly, controls movement of the saw assembly and defines the cutting plane. The gantry comprises a framework with rails defining axes of motion. Pairs of spaced apart parallel rails comprise tracks, which define each axis of motion. Linear actuators control motion along the axes. Legs of the gantry establish a cutting plane.

The gantry may be mounted to a utility vehicle in a manner that allows deployment for use and stowing for storage and transportation. The mounting may comprise pivoting joints. A winch attached to the gantry may raise and lower the gantry. In the raised position, the gantry is stowed for storage and transportation. In the lowered position, the gantry is deployed for cutting use. The utility vehicle may include a hydraulic pump and an air compressor for powering a hydraulic motor and a pneumatic actuator. The utility vehicle may also include a dust collection vacuum for collecting dust and debris.

Rollers coupled to the saw assembly facilitate linear translation of the saw assembly along a first axis. Each roller includes a V-shaped notch which rides against an angled rail. A pair of spaced apart parallel angled rails define the first axis of motion, and are collectively referred to as the first track.

The first track is movable along a second axes, which is orthogonal to the first axis. The parallel angled rails that define the first axis and comprise the first track are coupled to rollers that facilitate linear translation of the saw assembly along the second axis. A pair of spaced apart parallel angled rails define the second axis of motion, and are collectively referred to as the second track.

Movement along the first and second tracks is effectuated with linear actuators. In one embodiment, movement along the first track is effectuated using a pneumatic actuator, while movement along the second track is effectuated with a chain drive. The pneumatic actuator thus controls plunge cutting action of the saw assembly, while the chain drive controls side to side cutting action of the saw assembly.

In one embodiment, an exemplary walkway surface cutting system for removing a trip hazard from a walkway is provided. The walkway including a trip hazard (e.g., a raised portion) and a walkway surface without a trip hazard (e.g., the surrounding portions of the walkway. The trip hazard is higher than the walkway surface without the trip hazard. The system includes a gantry having a support framework including a first track and a second track. The first track is linearly movable along and orthogonal to the second track. A saw assembly includes a motor and a masonry saw blade (e.g., a blade suitable for cutting stone and/or concrete) operably coupled to and driven by the motor. The saw assembly is linearly movable along the first track. A support maintains the gantry at a cutting height and cutting angle relative to a portion of the walkway not to be cut. The cutting height and cutting angle is at a height and angle for the saw blade to cut the trip hazard without cutting the walkway surface without a trip hazard. A first linear actuator is operably coupled to the saw assembly. The first linear actuator includes a first stationary body and a first shaft controllably extendible from and retractable into the first stationary body. Extension of the first shaft causes linear movement of the saw assembly along the first track in a first direction. Retraction of the first shaft causes linear movement of the saw assembly along the first track in a second direction opposite the first direction. A second linear actuator is operably coupled to the first track. The second linear actuator includes a linearly moveable element and a control. Manipulation of the control causes linear movement of the linearly moveably element and the first track with the saw assembly along the second track.

The gantry has a front side and a back side, a right side and a left side. Cutting motion of the saw assembly progresses between front side and back side along the first track, and between left side and right side along the second track. Front to back motion is for plunging the saw blade into the trip hazard. Motion between the right and left sides is to sweep the saw blade along the width of the trip hazard.

In one embodiment the gantry is attached to a utility vehicle. A hinge couples the front of the gantry to the utility vehicle, e.g., to a bed of the utility vehicle. The gantry is pivotable about the hinge from a deployed position to a stowed position. A hoisting apparatus coupled to the utility vehicle and gantry and pivots the gantry between the deployed position and the stowed position. In one embodiment, the hoisting apparatus includes a manual or motorized winch attached to the utility vehicle and a tether (e.g., cable) extending from a spool of the winch to the gantry.

The support may include a back leg attached to the gantry adjacent to the back of the gantry and a front leg attached to the gantry adjacent to the front of the gantry. The front leg may be fixed in length and the back leg may be adjustable in length. The front leg may be fixed in length and the back leg may be a removable leg of a selectable length. The back leg may be fixed in length and the front leg may be adjustable in length. The back leg may be fixed in length and the front leg may be a removable leg of a selectable length. More than one back leg and front leg may be provided.

In one embodiment, the motor of the saw assembly is a hydraulic motor. A hydraulic pump (e.g., an engine driving a gear pump) supplies hydraulic fluid to the hydraulic motor.

In one embodiment, the first linear actuator is a pneumatic actuator. A control valve pneumatically coupled to the first linear actuator controls a flow of compressed air to the linear actuator from an air compressor.

In one embodiment, the second linear actuator is a chain drive. The chain drive includes a chain trained around a drive cog and a driven cog and having a straight segment extending therebetween. The straight segment of the chain is coupled to the first track. A shaft extends from the drive cog. A handle on the shaft allows control. Rotation of the handle causes rotation of the drive cog, which causes linear movement of the straight segment.

In one embodiment, a shroud (e.g., debris shield) is provided above the saw blade. The shroud includes a vacuum port coupled to a vacuum hose coupled to a vacuum for dust collection. A shield vertically movable relative to the shroud under the influence of contact with the walkway guards against propelled debris and helps to constrain dust from cutting.

BRIEF DESCRIPTION OF THE DRAWINGS

The foregoing and other aspects, objects, features and advantages of the invention will become better understood with reference to the following description, appended claims, and accompanying drawings, where:

Figure 1:
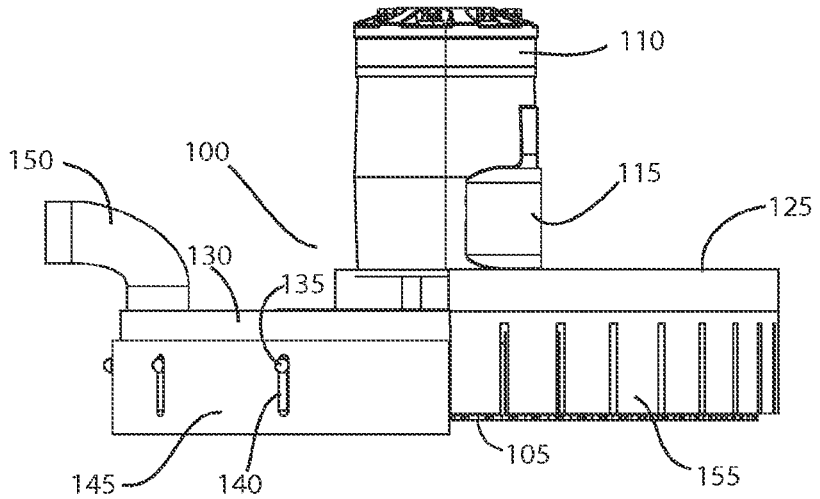
FIG. 1 is a side view of an exemplary saw assembly according to principles of the invention.
Figure 2:
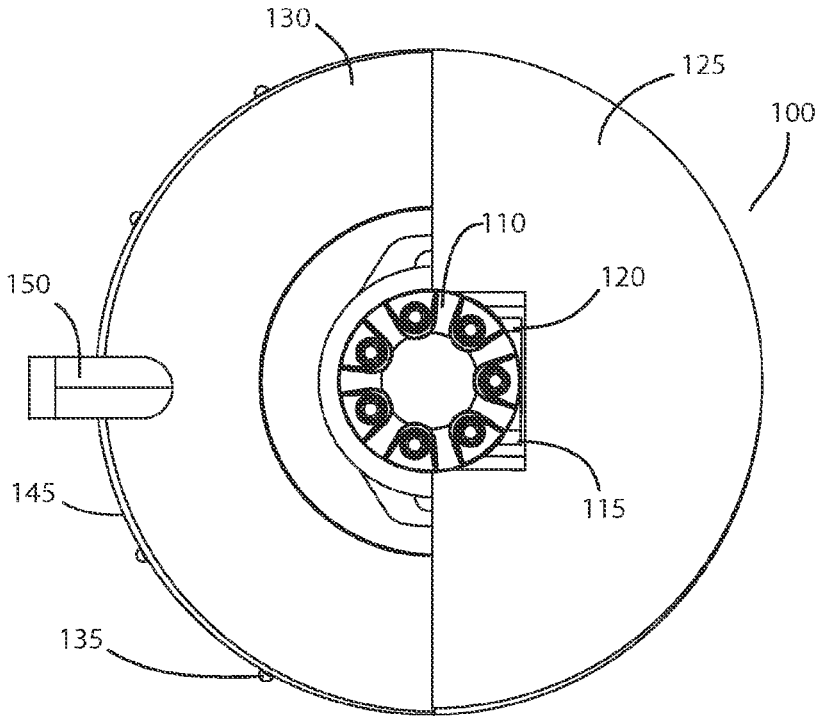
FIG. 2 is a plan view of an exemplary saw assembly according to principles of the invention.
Figure 3:
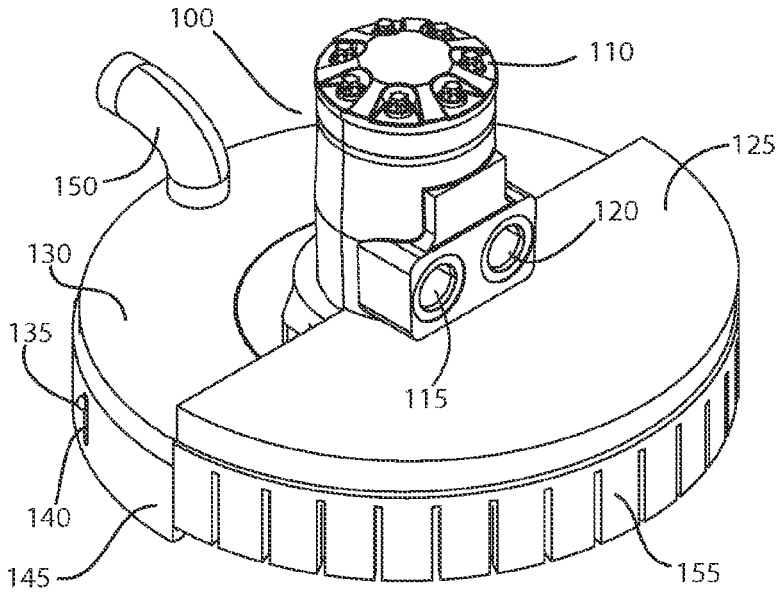
FIG. 3 is a top perspective view of an exemplary saw assembly according to principles of the invention.
Figure 4:
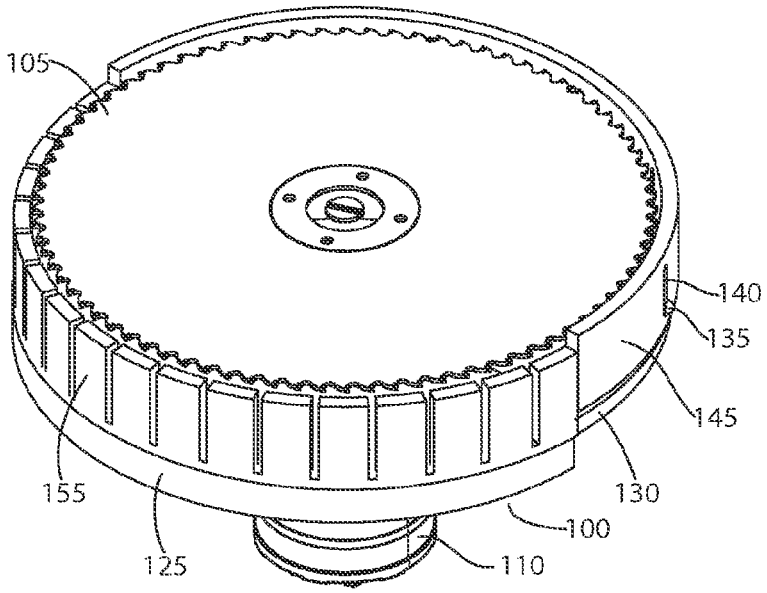
FIG. 4 is a bottom perspective view of an exemplary saw assembly according to principles of the invention.
Figure 5:
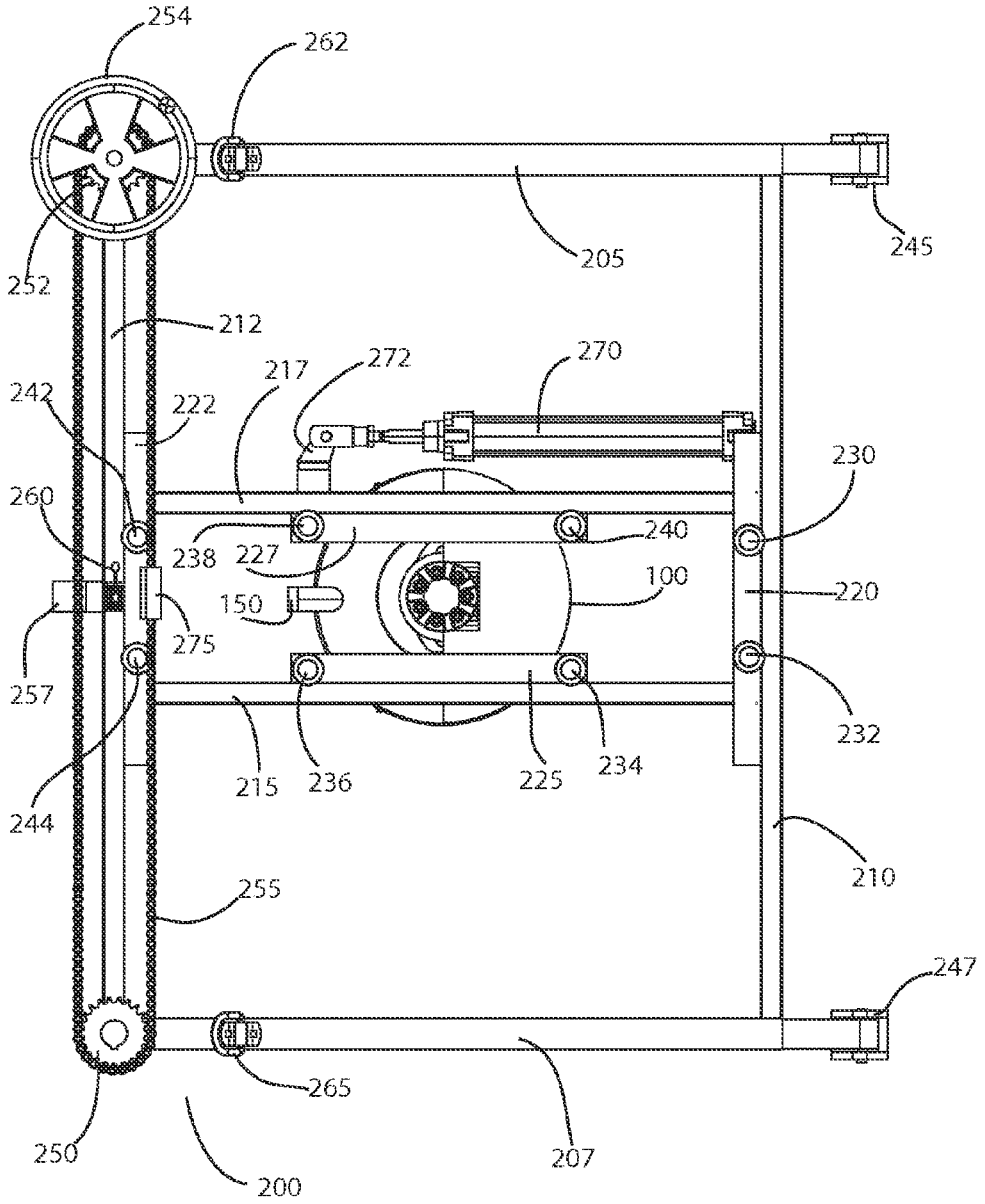
FIG. 5 is a plan view of an exemplary saw gantry according to principles of the invention.
Figure 6:
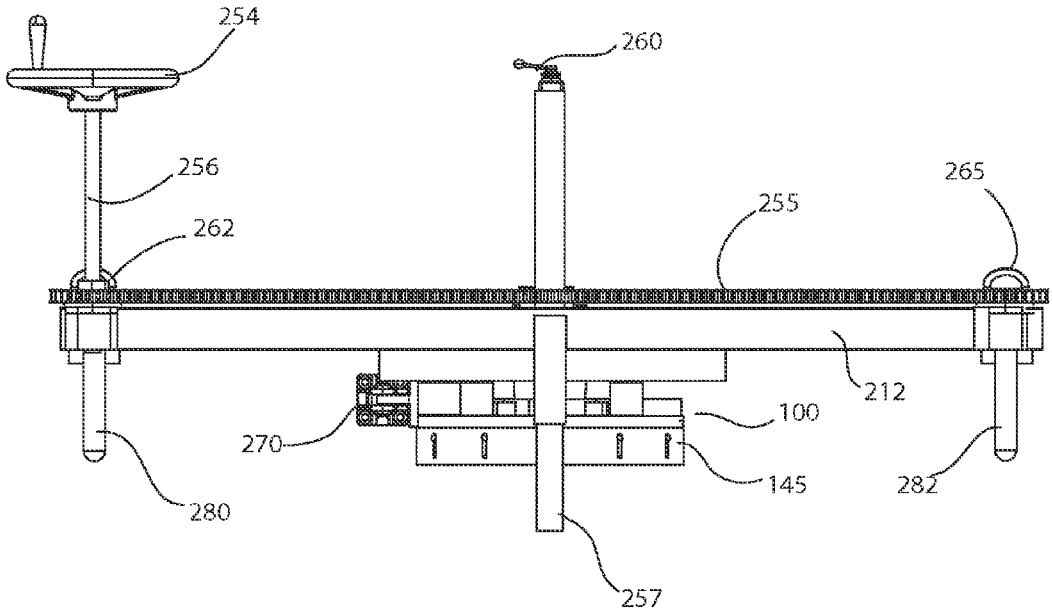
FIG. 6 is a back view of an exemplary saw gantry according to principles of the invention.
Figure 7:
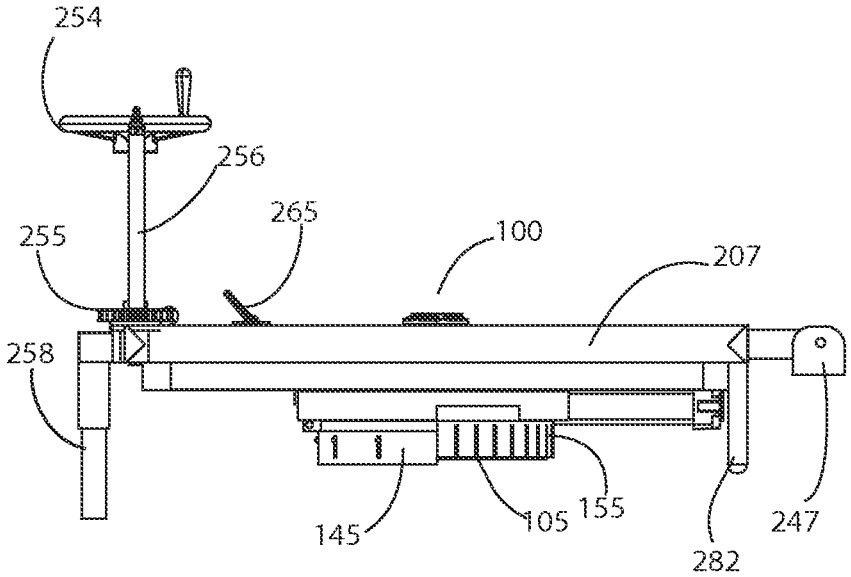
FIG. 7 is a side view of an exemplary saw gantry according to principles of the invention.
Figure 8:
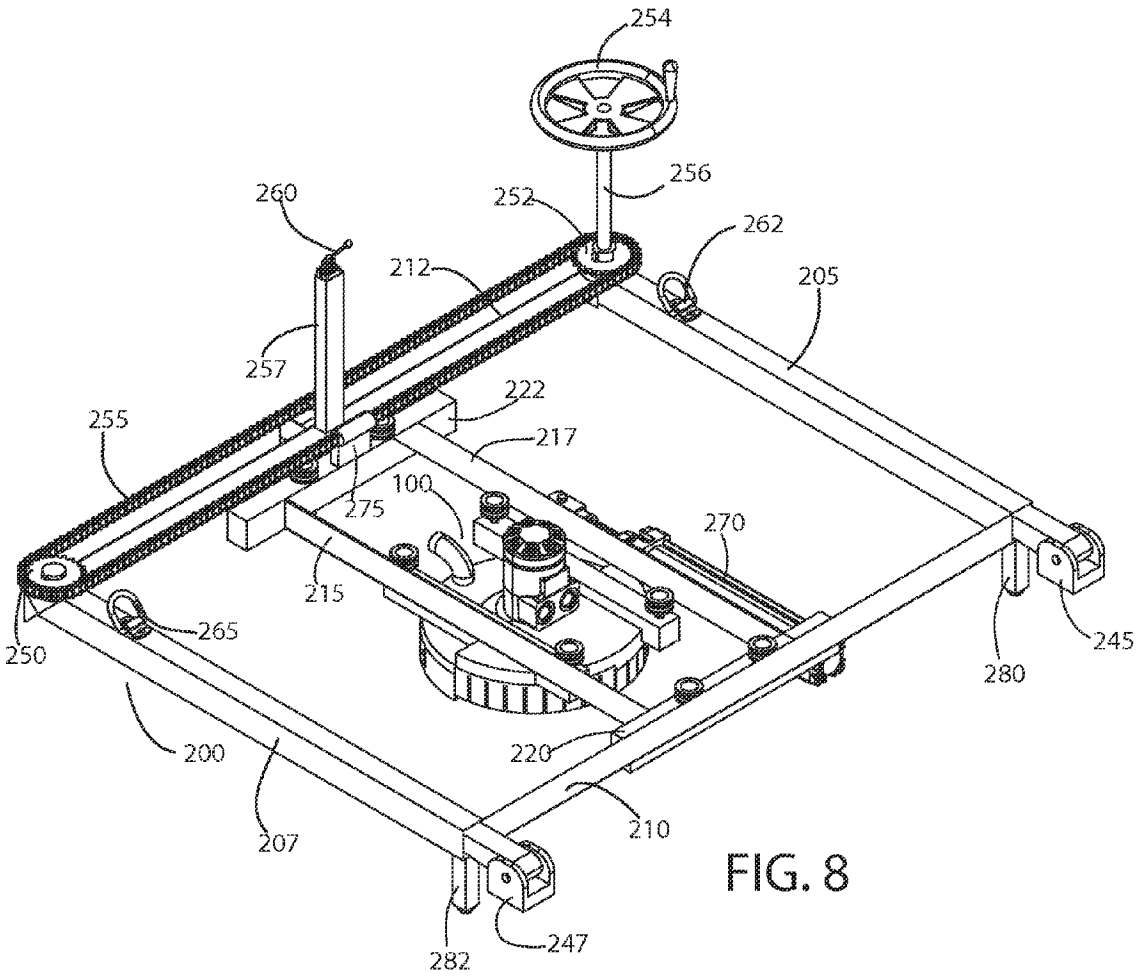
FIG. 8 is a first perspective view of an exemplary saw gantry according to principles of the invention.
Figure 9:
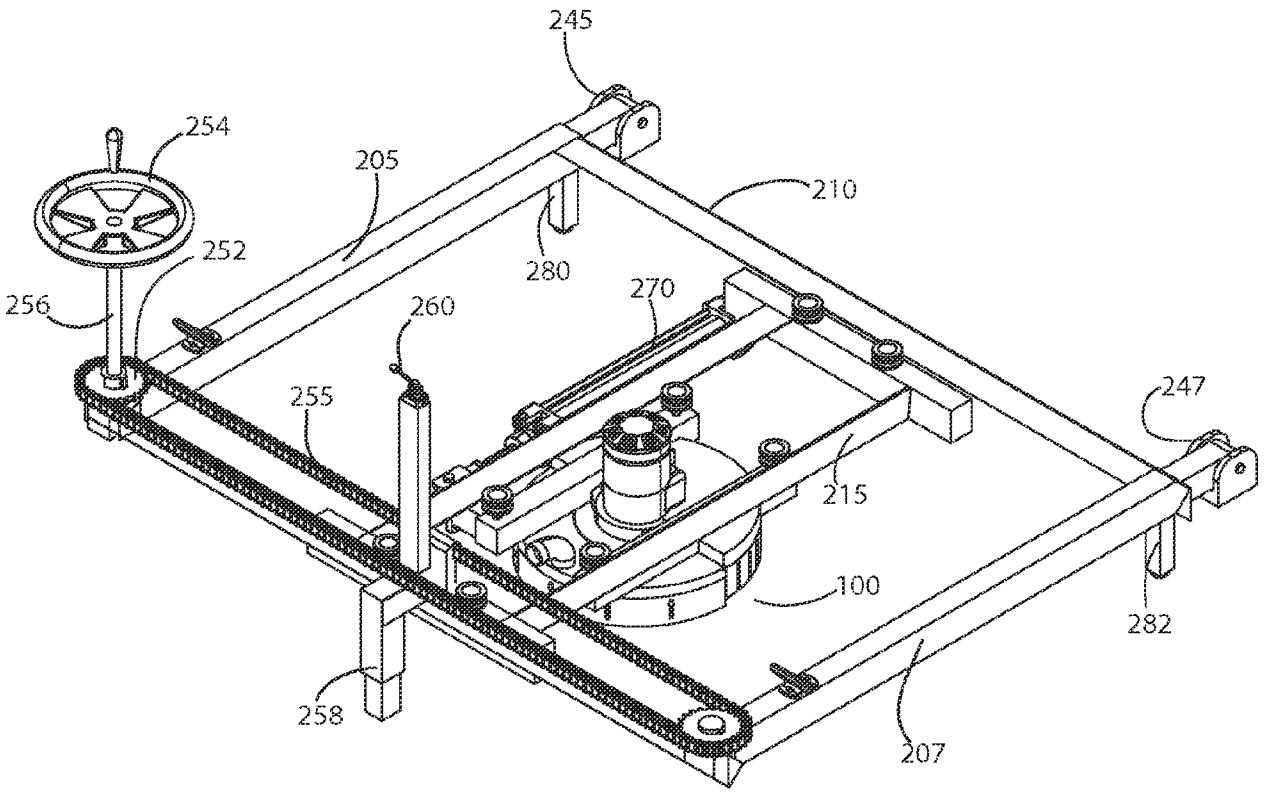
FIG. 9 is a second perspective view of an exemplary saw gantry according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

In general, an exemplary system according to principles of the invention comprises a saw assembly that controllably moves in a cutting plane along two orthogonal axes. An exemplary saw assembly includes a circular toothed blade that is configured to cut concrete and similar materials. A motor, such as a hydraulic motor, rotatably drives the saw blade. An adjustable shroud substantially surrounds the blade and confines dust and debris. A vacuum port of the shroud connects to a dust-removal vacuum via a hose.

A gantry supports the saw assembly, controls movement of the saw assembly and defines the cutting plane. The gantry comprises a framework with rails defining axes of motion. Pairs of spaced apart parallel rails comprise tracks, which define each axis of motion. Linear actuators control motion along the axes. Legs of the gantry establish a cutting plane.

The gantry may be mounted to a utility vehicle in a manner that allows deployment for use and stowing for storage and transportation. The mounting may comprise pivoting joints. A winch attached to the gantry may raise and lower the gantry. In the raised position, the gantry is stowed for storage and transportation. In the lowered position, the gantry is deployed for cutting use. The utility vehicle may include a hydraulic pump and an air compressor for powering a hydraulic motor and a pneumatic actuator. The utility vehicle may also include a vacuum for collecting dust and debris.

Rollers coupled to the saw assembly facilitate linear translation of the saw assembly along a first axis. Each roller includes a V-shaped notch which rides against an angled rail. A pair of spaced apart parallel angled rails define the first axis of motion, and are collectively referred to as the first track.

The first track is movable along a second axes, which is orthogonal to the first axis. The parallel angled rails that define the first axis and comprise the first track are coupled to rollers that facilitate linear translation of the saw assembly along the second axis. A pair of spaced apart parallel angled rails define the second axis of motion, and are collectively referred to as the second track.

Movement along the first and second tracks is effectuated with linear actuators. In one embodiment, movement along the first track is effectuated using a pneumatic actuator, while movement along the second track is effectuated with a chain drive. The pneumatic actuator thus controls plunge cutting action of the saw assembly, while the chain drive controls side to side cutting action of the saw assembly.

Referring now to FIGS. 1 through 4, an exemplary saw assembly 100 according to principles of the invention is conceptually illustrated. A motor 110 (e.g., hydraulic motor) is operably coupled to and rotatably drives a circular saw blade 105. The blade is a circular blade suitable for cutting cutting concrete, masonry, brick, asphalt, tile, and other solid materials. Industrial diamonds are fixed on cutting edges of the blade. The coupling may comprise a drive shaft, gear train, belt or chain drive and combinations of the foregoing. While the saw may be powered by a gasoline, hydraulic, pneumatic, or electric motor, a hydraulic motor is preferred. Such a motor 110 includes at least two hydraulic fluid ports 115 and 120, one serving as an inlet and the other as an outlet. The ports 115, 120 are coupled to a source of pressurized hydraulic fluid, such as a hydraulic pump, via hydraulic lines (i.e., hoses).

A forward shroud 125 and an aft shroud 130 cover the blade 105. A flexible protective skirt 155 extends downwardly from the periphery of the forward shroud 125. The skirt 155 guards against dust and debris propelled by the spinning circular saw blade 105. The flexible skirt 155 may comprise brush bristles or flexible plastic elements. The saw blade 105 is exposed at the bottom of the skirt 155. A floating rigid guard 145 is movably coupled to the aft shroud 130. Pins 135 and elongated slots 140 in the guard 145 allow up and down movement of the guard 145, while holding the guard 145 to the aft shroud 130. Thus, the aft shroud may drop to the level of the walkway being cut.

A vacuum port 150 in the aft shroud 130 may be coupled to a hose leading to a vacuum for the collection of dust and debris. The vacuum port 150 is in communication with the cavity defined by the shroud 130 and guard 145 and shroud 125 and guard 155, in which the blade 105 resides. Thus, dust and debris from cutting are removed from the cavity through the port 150 to a vacuum.

Referring now to FIGS. 5 through 9 an exemplary saw gantry 200 according to principles of the invention is conceptually illustrated. The saw assembly 100 described above is shown roughly in the center of the gantry 200. The gantry 200 supports the saw assembly 100, controls movement of the saw assembly 100 and defines a cutting plane. The gantry 200 comprises a framework with pairs of parallel rails 210, 212 and 215, 217, each pair defining an axis of motion. Each pairs of spaced apart parallel rails 210, 212 and 215, 217 comprise a track, which defines an axis of motion. Linear actuators 255, 270 control motion along the axes.

The saw assembly 100 is attached to parallel spaced apart support bars 225, 227. Rollers 234, 236 are rotatably attached to support bar 225. Rollers 238, 240 are rotatably attached to support bar 227. One set of rollers 234, 236 travel along one rail 215, while the other set of rollers 238, 240 travel along the spaced apart parallel rail 217. Thus, linear translation of the saw assembly 100 along one axis (i.e., the first axis or plunge cut axis) is enabled. More specifically, the saw assembly 100 may move back and forth along the first track comprised of rails 215, 217. The range of motion is determined in part by the length of the rails 215, 217. In a preferred embodiment, the range of motion is at least (and preferably greater than) ½ of the diameter of the saw blade 105, to enable plunge cutting.

The rails 215, 217 are attached at opposite ends to parallel spaced apart support bars 220, 222. Rollers 230, 232 are rotatably attached to support bar 220. Rollers 242, 244 are rotatably attached to support bar 222. One set of rollers 230, 232 travel along one rail 210, while the other set of rollers 242, 244 travel along the spaced apart parallel rail 212. Thus, linear translation of the saw assembly 100 on along a second axis (or the side to side axis) is enabled. More specifically, the saw assembly 100 may move side to side along the second track comprised of rails 210, 212. The range of motion is determined in part by the length of the rails 210, 212. In a preferred embodiment, the range of motion is at least (and preferably greater than) the width of a walkway (e.g., 60 inches). However, the invention is not so limited. Rails 210, 212 providing less range of motion may be utilized, though multiple cuts may be required to extend across the entire width of a sidewalk.

The second track is orthogonal to the first track. The second axis is orthogonal to the first axis. The second axis is parallel to the second track. The first axis is parallel to the first track. The rails comprising the second track are parallel to the second axis. The rails comprising the first track are parallel to the first axis.

Linear actuators effect movement along the first and second tracks, and along their corresponding axes. In one embodiment, movement along the first track comprised of rails 215, 217 is effectuated using a pneumatic actuator 270, while movement along the second track comprised of rails 210, 212 is effectuated with a chain drive 255. The particular location of each linear actuator is not important, so long as it achieves the desired motion.

The pneumatic actuator 270 uses the power of compressed gas (e.g., air) to produce a force in a linear motion. The pneumatic actuator 270 is pneumatically coupled by air supply lines to a source of compressed air, such as an air compressor with a compressed air storage tank. The pneumatic actuator 270 may be double-acting to facilitate motion in either direction along the first axis. A valve 260 pneumatically coupled to the actuator 270 controls the flow of compressed air to the actuator 270. A user controls the valve 260. The pneumatic actuator 270 is mechanically coupled at one end to a forward rail 210, and at its opposite end, via a pivoting joint 272, to the saw assembly 100 or to the support bar 227. The pneumatic actuator 270 controls plunge cutting action of the saw assembly, while the chain drive 255 controls side to side cutting action of the saw assembly.

A chain drive assembly effectuates side-to-side movement along the second track comprised of rails 210, 212. The assembly includes a continuous chain 255 entrained around a first sprocket 250 and an opposite drive sprocket 252. A shaft 256 extends from the drive sprocket 252 to a handle 254. Turning the handle 254 rotates the drive sprocket 252, which causes the chain 255 to move. The length of chain 255 between the sprockets 250, 252 moves in a linear fashion, one way or another, depending upon the direction of rotation. A coupling 275 connects the chain between the sprockets to the support bar 222. Consequently, linear motion of the length of chain 255 between the sprockets 250, 252 causes the coupling 275 and attached support bar 222 to move linearly. Thus, rotation of the handle 254 in one direction, causes linear motion of the length of chain 255 between the sprockets 250, 252 in one direction, which causes the support bar 222 to travel along rail 212 in the same direction. Such linear motion of the support bar 222 causes, linear translation of the saw assembly 100 on along a second axis (or the side to side axis) is enabled. More rotating the handle 254 moves (linearly translates) the saw assembly 100 along the second track comprised of rails 210, 212. The direction of movement is a function of the direction of rotation of the handle 254. The speed of movement is a function of the rate of rotation of the handle 254 and the size of the drive sprocket 252.

The gantry may be mounted to a utility vehicle in a manner that allows deployment for use and stowing for storage and transportation. The mounting may comprise pivoting joints 245, 247, (e.g., hinges) each of which may be attached to a bed of a utility vehicle. Such joints allow pivoting deployment of the gantry from the bed of a utility vehicle.

Forward legs 280, 282 and an aft leg 257 establish a cutting plane. The aft leg 257 may be adjustable in height or replaceable with a leg of a desired length. An adjustable height leg may include telescoping portions. One segment of the leg may slide or thread from another receiving segment of the leg to adjust the height. A locking mechanism such as a pin may secure the leg at a desired length. The forward legs 280, 282 end at, meet and define the cutting plane. The length of the aft leg 257 defines the angle of the cutting plane. The saw blade 105 cuts in the cutting plane.

One or more attachments (e.g., D-rings 262, 265) are also provided. These attachments enable connection to a cable, chain, strap or other tether to winch or hoist the gantry 200 from a stowed position to a deployed position and from a stowed position to a deployed position.

Figure 10:
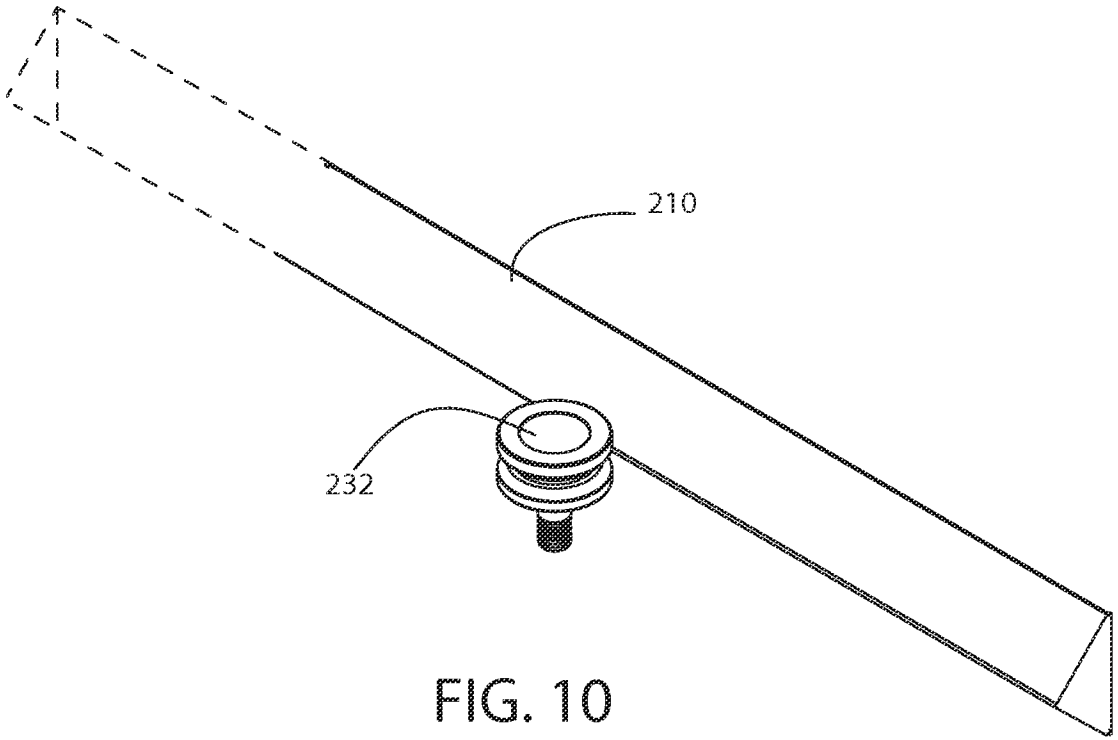
FIG. 10 is a perspective view of an exemplary roller and angled track for a saw gantry according to principles of the invention.

In FIG. 10, a perspective view of an exemplary roller 232 and mating angled rail 210 for a track of a saw gantry according to principles of the invention is conceptually illustrated. An exemplary roller 232 is a hardened steel thrust-load-rated track roller with a v-groove that provides accurate positioning on a 90° angle rail. The rail 210 may comprise 90° steel angle iron with a welded backing for additional rigidity. Such a roller 232 facilitates linear translation along the rail 210.

Figure 11:
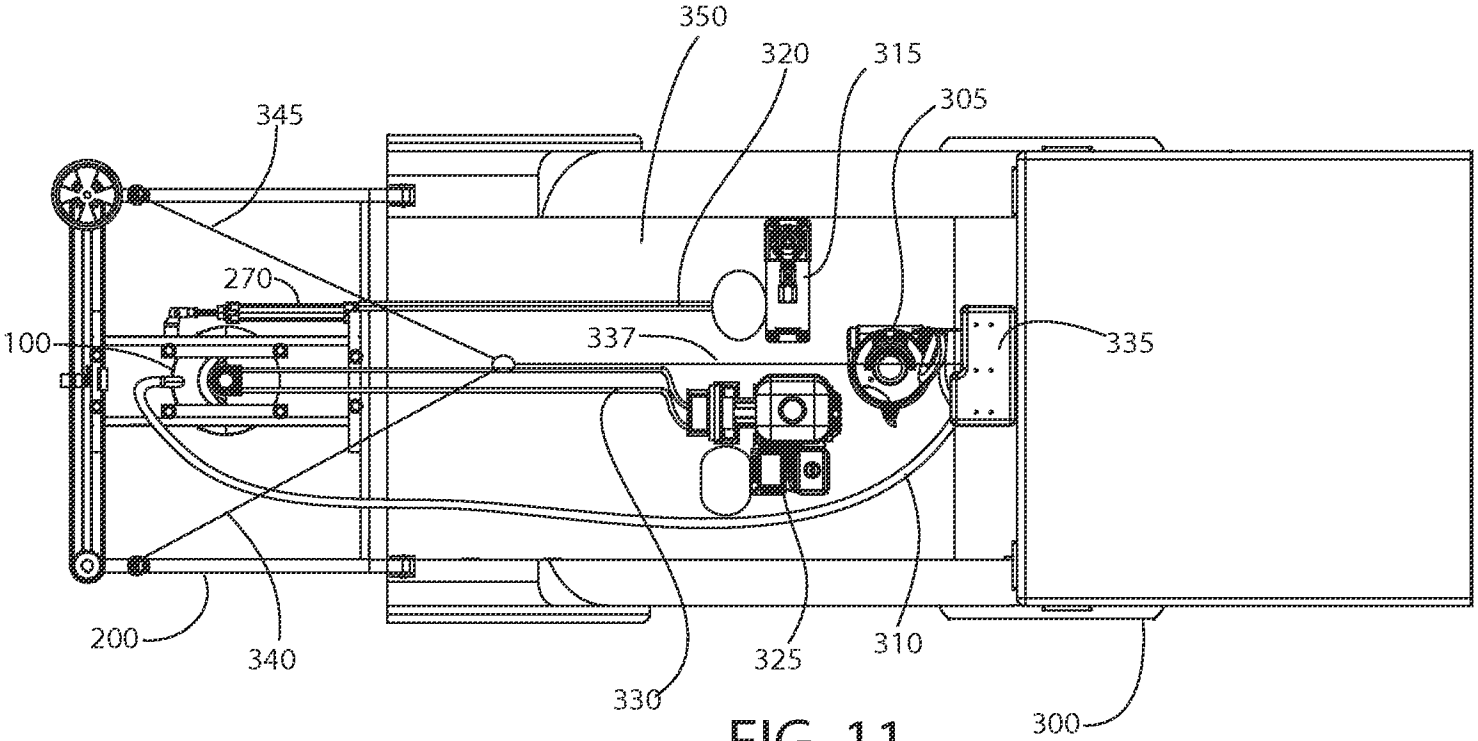
FIG. 11 is a plan view of an exemplary utility vehicle equipped with a saw gantry according to principles of the invention.
Figure 12:
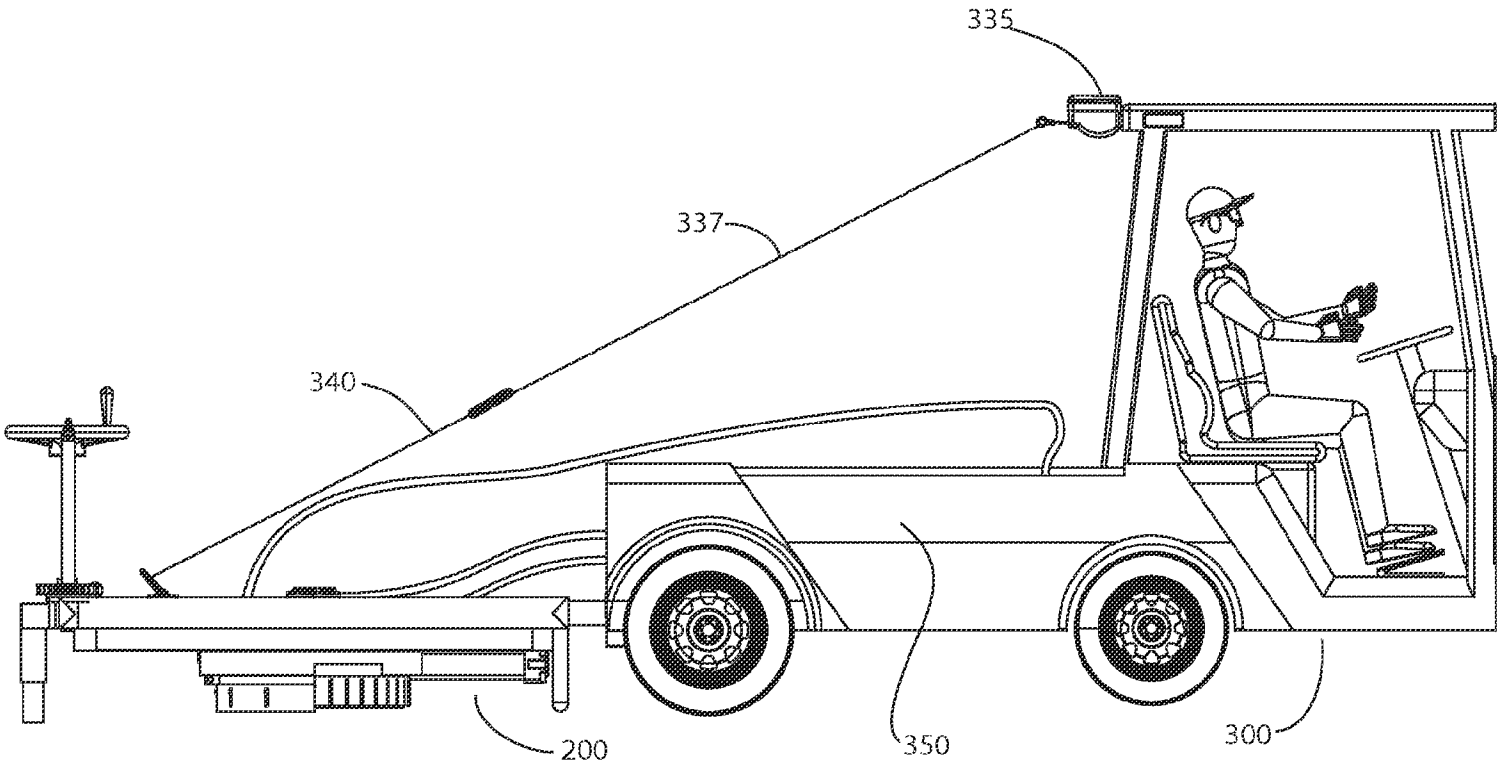
FIG. 12 is a side view of an exemplary utility vehicle equipped with a saw gantry in a deployed position according to principles of the invention.
Figure 13:
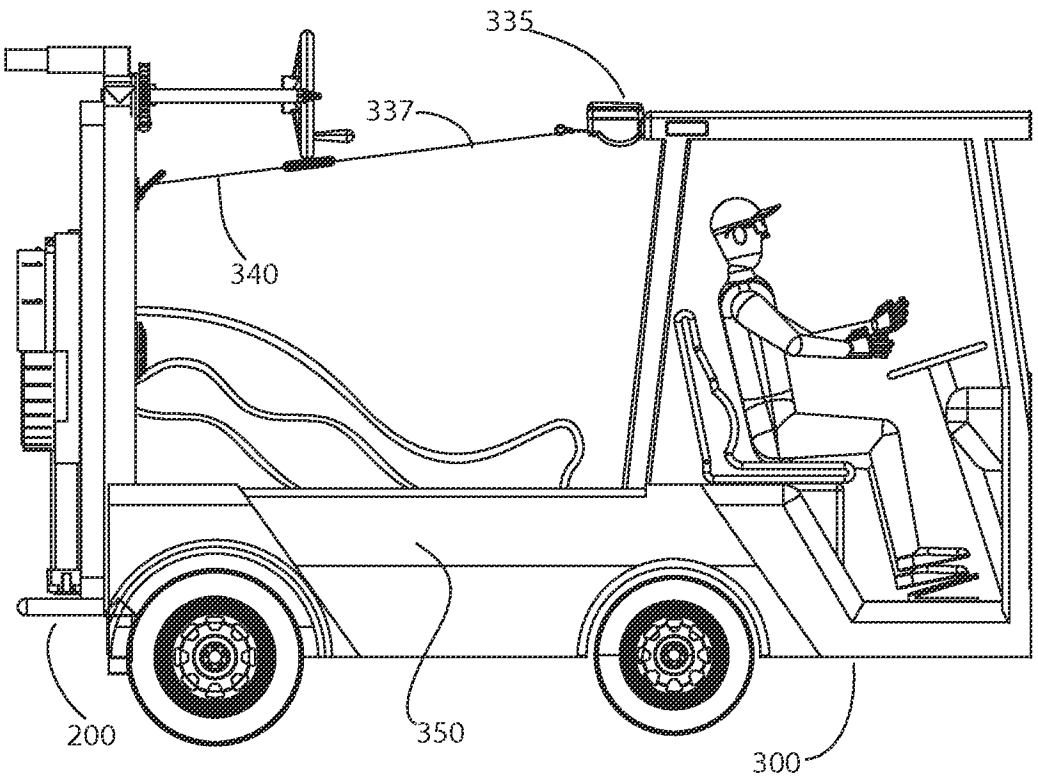
FIG. 13 is a side view of an exemplary utility vehicle equipped with a saw gantry in a stowed position according to principles of the invention.
Figure 14:
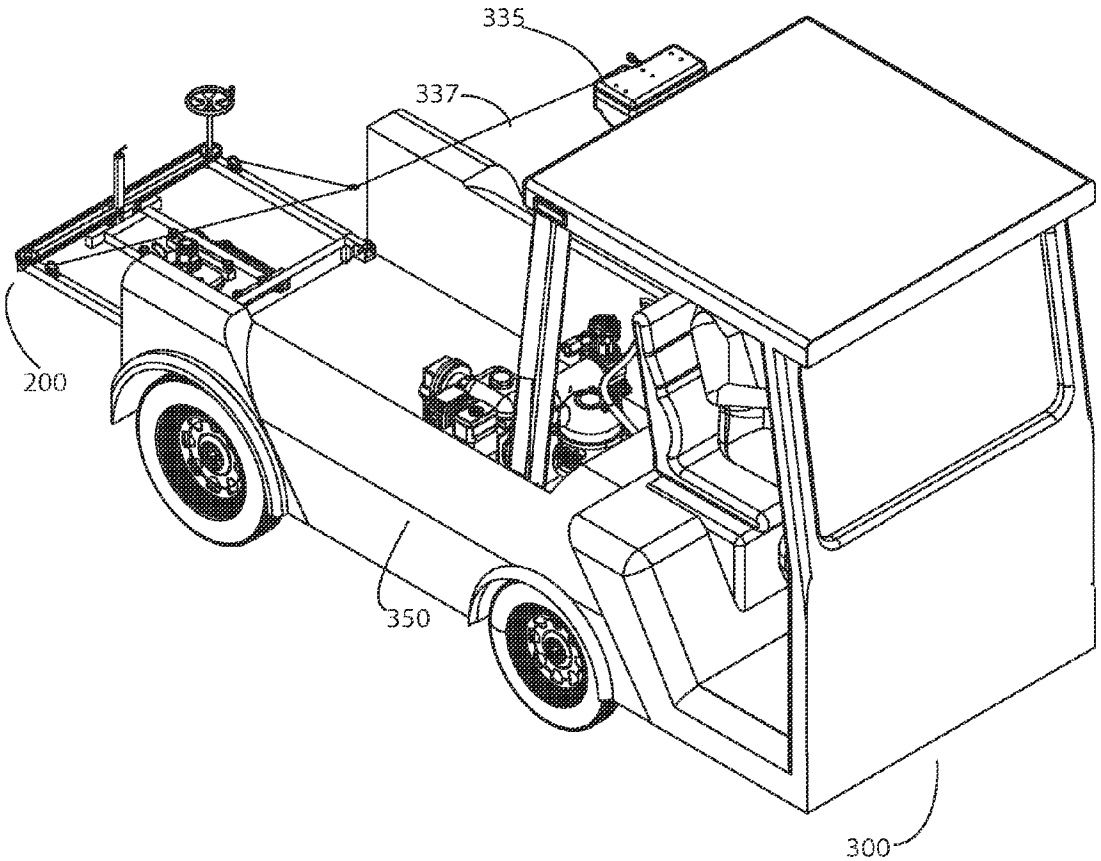
FIG. 14 is a perspective view of an exemplary utility vehicle equipped with a saw gantry in a deployed position according to principles of the invention.

FIGS. 11 through 14 provide various views of an exemplary utility vehicle 300 equipped with a saw gantry 200 according to principles of the invention. In FIGS. 11, 12 and 14, the gantry 200 is shown in the deployed position. In the deployed position, the gantry extends outwardly from the hinges 245, 247 attached to the back of the truck bed 350. In the stowed position as shown in FIG. 13, the gantry 200 is pivoted to an upright position.

A tether, such as a strap, cable or rope 337 is connected to attachments on the gantry. In the embodiment shown in FIGS. 11-14, the tether 337 is coupled to a pair of tethers 340, 345, each of which connects to a D-ring 262, 265. The tether 337 is wound from a spool of a winch 335. Rotation of the spool in one direction winds up the tether 337, pulling the gantry 200 to the stowed position. Rotation of the spool in one direction releases the tether 337, dropping the gantry 200 to the deployed position. Thus, the winch 335 attached to the gantry 200 raises and lowers the gantry. In the raised position, the gantry 200 is stowed for storage and transportation. In the lowered position, the gantry 200 is deployed for cutting use. The winch may be manual, aulic or pneumatic.

The utility vehicle 300 may include an engine driven hydraulic pump 325, and an air compressor 315 for powering a hydraulic motor 110 and a pneumatic actuator 270. Hydraulic fluid is pumped from the pump 325 to a port 115, 120 of the motor 110 of the saw assembly 100 and back to the pump 325 via hydraulic hoses 330. Compressed air is pumped from the compressor 315 to the pneumatic actuator 270 via pneumatic hoses 320, controlled by valve 260. The utility vehicle 300 may also include a vacuum 305 for collecting dust and debris via a vacuum hose 310 coupled to the saw assembly 100. Electric power for the vacuum 305 and compressor 315 may be supplied by a battery in the vehicle 300, by an electric generator or alternator of the vehicle 300, or a supplemental electric power source.

Figure 15:
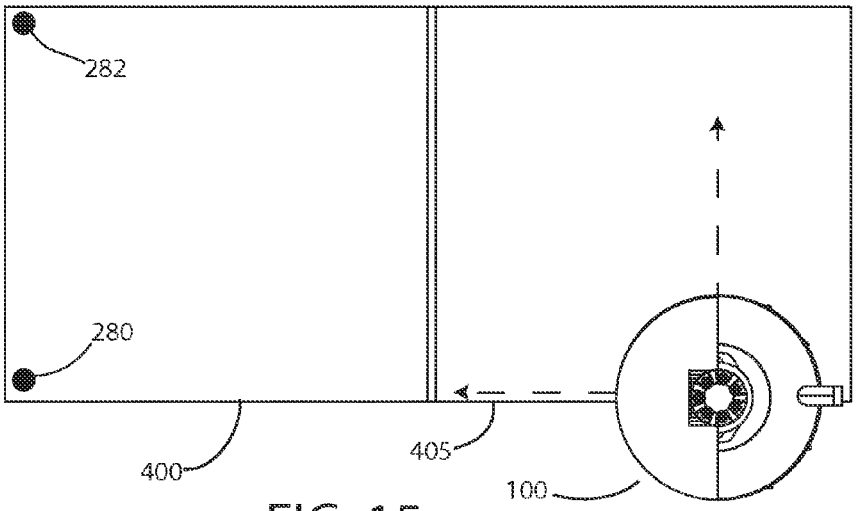
FIGS. 15, 16, and 17 are schematics that conceptually illustrate a step of an exemplary method of repairing a sidewalk according to principles of the invention.
Figure 16:
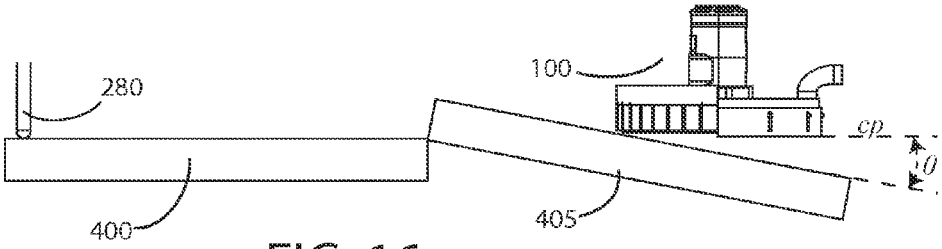
Figure 17:
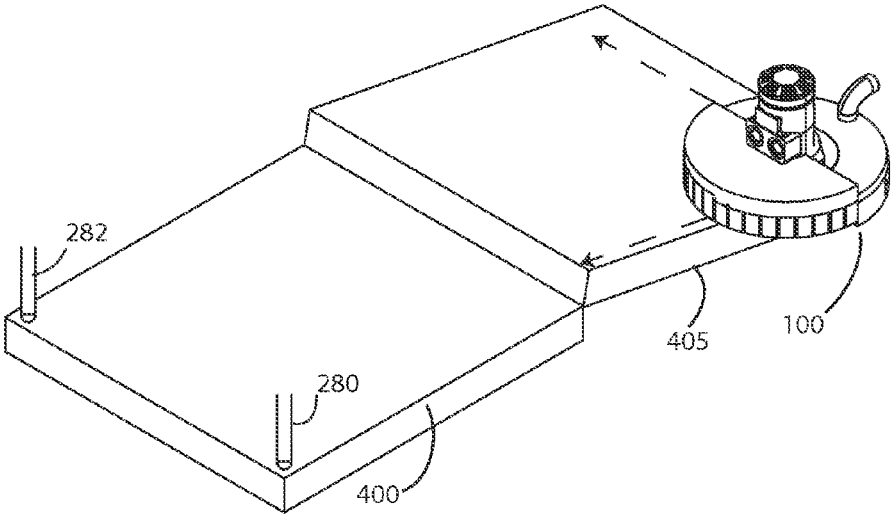

A method of repairing a sidewalk or other walkway according to principles of the invention entails positioning the saw assembly, as illustrated in FIGS. 15-17. The saw assembly 100 is positioned with the cutting side, i.e., side 155, facing the portion of the walkway to be cut. The saw assembly 100 is positioned at one side of the portion of the walkway to be cut. The forward legs 280, 282 are positioned forward of the cutting side 155 of the saw assembly 200. The forward legs 280, 282 define the forward edge of the cutting plane cp. In other words, as the saw assembly 200 proceeds forward during a plunge cut, the plane in which the cut is made is the cutting plane cp. The cutting plane cp extends from the saw 105 to the forward legs 280, 282. The angle θ of the cutting plane cp relative to the walkway to be cut is defined by the forward legs 280, 282 and the aft leg 257. In a particular embodiment, forward legs 280, 282 are a fixed length and the length of the aft leg 257, which is adjustable, defines the angle θ of the cutting plane—the longer the length of the aft leg 257, the greater the angle θ of the cutting plane. From the initial position, the saw assembly may move towards the forward legs 280, 282 and towards the opposite side of the portion of the walkway to be cut, as illustrated by the dashed lines in FIGS. 15 and 17.

Figure 18:
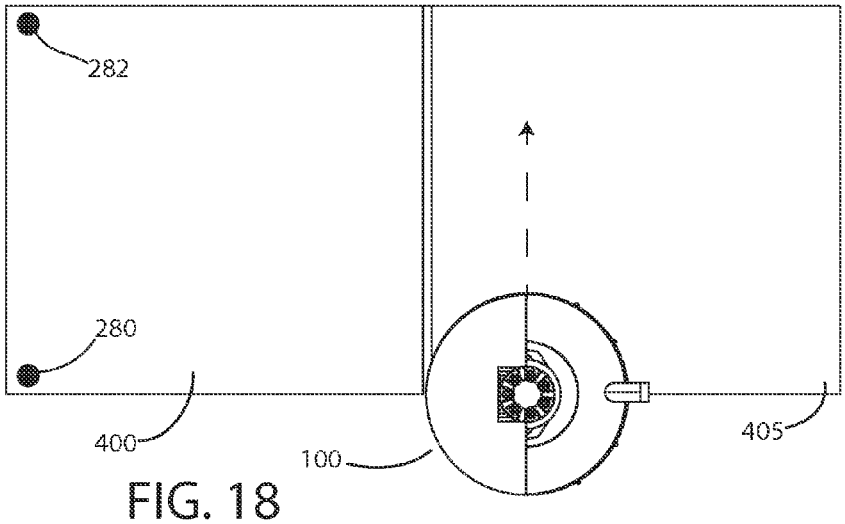
FIGS. 18, 19, and 20 are schematics that conceptually illustrate another step of an exemplary method of repairing a sidewalk according to principles of the invention.
Figure 19:
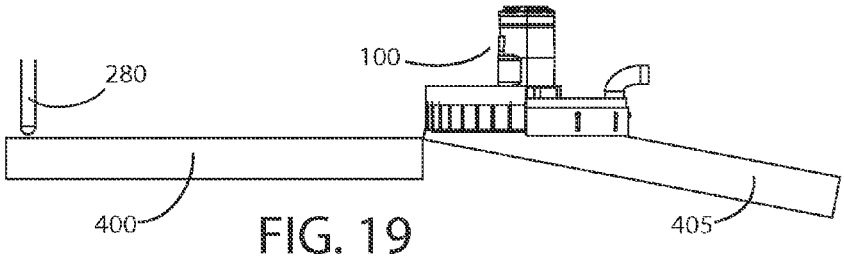
Figure 20:
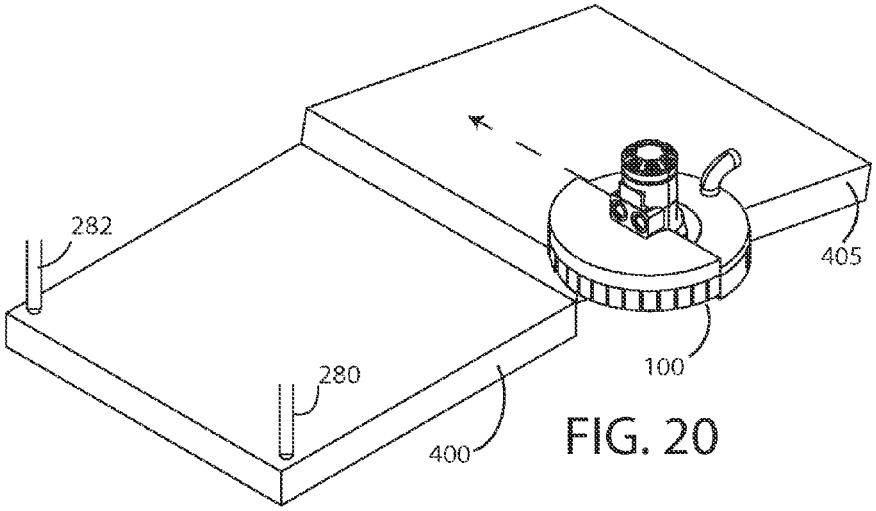

FIGS. 18, 19, and 20 are schematics that conceptually illustrate a subsequent step of an exemplary method of repairing a sidewalk according to principles of the invention. In FIGS. 18, 19, and 20 a plunge cut is made. A plunge cut is a cut into the portion of the walkway to be cut. The plunge cut is made by moving the saw assembly 100 towards the forward legs 280, 282. The plunge is accomplished using the linear (pneumatic) actuator 270, controlled by valve 260. The depth of the plunge cut is defined by the forward motion of the saw assembly 100. The depth of the plunge cut is not greater than the diameter of the saw blade 105. Successive plunge cuts may be made if the portion to be cut away is appreciably greater in depth than the diameter of the saw blade 105.

Figure 21:
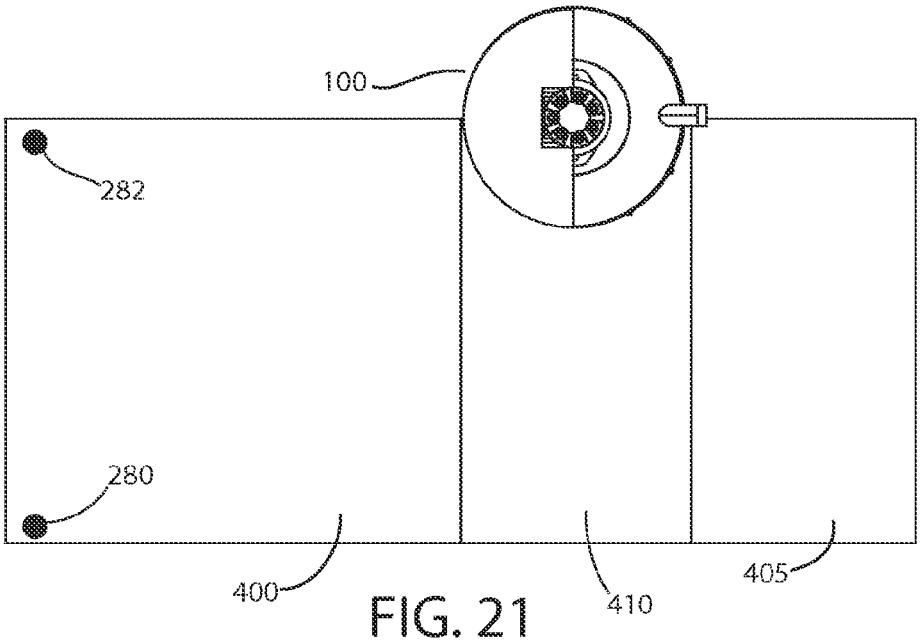
FIGS. 21, 22, and 23 are schematics that conceptually illustrate yet another step of an exemplary method of repairing a sidewalk according to principles of the invention.
Figure 22:
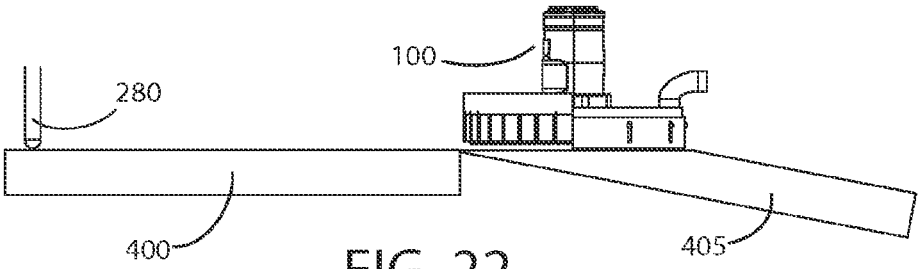
Figure 23:
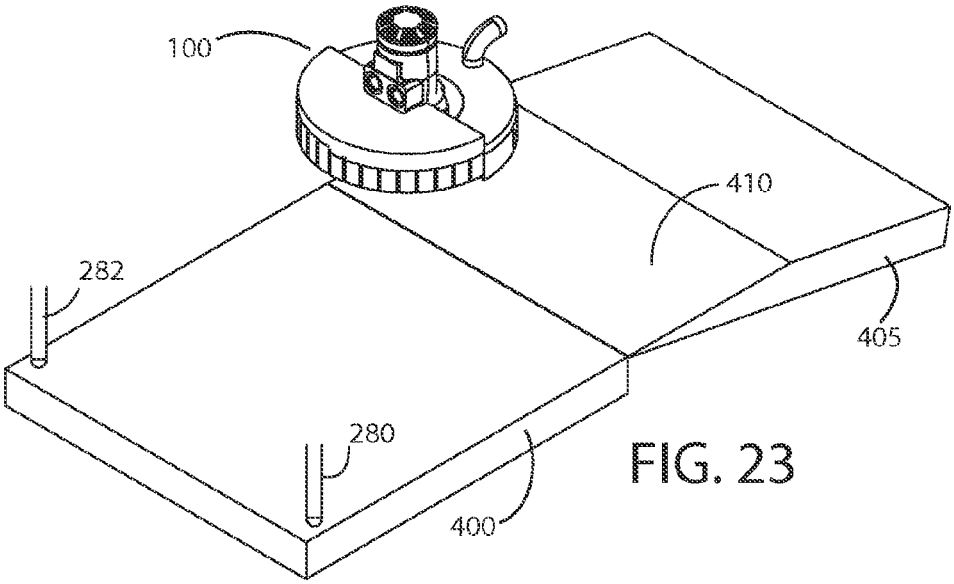

FIGS. 21, 22, and 23 are schematics that conceptually illustrate yet another subsequent step of an exemplary method of repairing a sidewalk according to principles of the invention. In this step, the saw assembly 100 is moved from the plunge cut position towards the opposite side of the portion of the walkway to be cut. As the saw assembly moves, it cuts the walkway to the depth of the plunge cut from the initial plunge position to the opposite side. All the while, dust is collected by the vacuum 305 via vacuum hose 310. The sideways motion of the saw assembly is accomplished using the chain drive 255, controlled using handle 254.

In sum, an exemplary walkway surface cutting system for removing a trip hazard from a walkway is provided. The walkway including a trip hazard (e.g., a raised portion) and a walkway surface without a trip hazard (e.g., the surrounding portions of the walkway. The trip hazard is higher than the walkway surface without the trip hazard. The system includes a gantry having a support framework including a first track and a second track. The first track is linearly movable along and orthogonal to the second track. A saw assembly includes a motor and a masonry saw blade (e.g., a blade suitable for cutting stone and/or concrete) operably coupled to and driven by the motor. The saw assembly is linearly movable along the first track. A support maintains the gantry at a cutting height and cutting angle relative to a portion of the walkway not to be cut. The cutting height and cutting angle is at a height and angle for the saw blade to cut the trip hazard without cutting the walkway surface without a trip hazard. A first linear actuator is operably coupled to the saw assembly. The first linear actuator includes a first stationary body and a first shaft controllably extendible from and retractable into the first stationary body. Extension of the first shaft causes linear movement of the saw assembly along the first track in a first direction. Retraction of the first shaft causes linear movement of the saw assembly along the first track in a second direction opposite the first direction. A second linear actuator is operably coupled to the first track. The second linear actuator includes a linearly moveable element and a control. Manipulation of the control causes linear movement of the linearly moveably element and the first track with the saw assembly along the second track.

The gantry has a front side and a back side, a right side and a left side. Cutting motion of the saw assembly progresses between front side and back side along the first track, and between left side and right side along the second track. Front to back motion is for plunging the saw blade into the trip hazard. Motion between the right and left sides is to sweep the saw blade along the width of the trip hazard.

In one embodiment the gantry is attached to a utility vehicle. A hinge couples the front of the gantry to the utility vehicle, e.g., to a bed of the utility vehicle. The gantry is pivotable about the hinge from a deployed position to a stowed position. A hoisting apparatus coupled to the utility vehicle and gantry and pivots the gantry between the deployed position and the stowed position. In one embodiment, the hoisting apparatus includes a manual or motorized winch attached to the utility vehicle and a tether (e.g., cable) extending from a spool of the winch to the gantry.

The support may include a back leg attached to the gantry adjacent to the back of the gantry and a front leg attached to the gantry adjacent to the front of the gantry. The front leg may be fixed in length and the back leg may be adjustable in length. The front leg may be fixed in length and the back leg may be a removable leg of a selectable length. The back leg may be fixed in length and the front leg may be adjustable in length. The back leg may be fixed in length and the front leg may be a removable leg of a selectable length. More than one back leg and front leg may be provided.

In one embodiment, the motor of the saw assembly is a hydraulic motor. A hydraulic pump (e.g., an engine driving a gear pump) supplies hydraulic fluid to the hydraulic motor.

In one embodiment, the first linear actuator is a pneumatic actuator. A control valve pneumatically coupled to the first linear actuator controls a flow of compressed air to the linear actuator from an air compressor.

In one embodiment, the second linear actuator is a chain drive. The chain drive includes a chain trained around a drive cog and a driven cog and having a straight segment extending therebetween. The straight segment of the chain is coupled to the first track. A shaft extends from the drive cog. A handle on the shaft allows control. Rotation of the handle causes rotation of the drive cog, which causes linear movement of the straight segment.

In one embodiment, a cowl (e.g., debris shield) is provided above the saw blade. The cowl includes a vacuum port coupled to a vacuum hose coupled to a vacuum for dust collection. A shield vertically movable relative to the cowl under the influence of contact with the walkway guards against propelled debris and helps to constrain dust from cutting.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A walkway surface cutting system for removing a trip hazard from a walkway, said walkway including a trip hazard and a walkway surface without a trip hazard, the trip hazard being higher than the walkway surface without the trip hazard, said system comprising:

a gantry comprising a support framework including a first track and a second track, the first track being linearly movable along and orthogonal to the second track, said gantry having a front side and a back side, a right side and a left side;

a saw assembly comprising a motor, a masonry saw blade operably coupled to and driven by the motor, said saw assembly being linearly movable along the first track, cutting motion of the saw assembly progressing between the front side and the back side along the first track and between the left side and the right side along the second track, said masonry saw blade comprising a circular blade having peripheral cutting teeth;

a support comprising a plurality of legs maintaining the second track of the gantry at a cutting height and cutting angle relative to a portion of the walkway not to be cut, said cutting height and cutting angle being at a height and angle for the saw blade to cut the trip hazard without cutting the walkway surface without the trip hazard, said plurality of legs including at least one back leg attached to the second track at the back side of the gantry, and at least one back leg attached to the second track at the front side of the gantry, and at least one of the plurality of legs being a leg of user-selectable height, and said plurality of legs straddling the trip hazard of the walkway surface and defining a cutting plane intersecting the trip hazard of the walkway surface at said cutting height and cutting angle;

a first linear actuator operably coupled to the saw assembly, said first linear actuator including a first stationary body and a first shaft controllably extendible from and retractable into the first stationary body, extension of the first shaft causing linear movement of the saw assembly along the first track in a first direction, and retraction of the first shaft causing linear movement of the saw assembly along the first track in a second direction opposite the first direction; and a second linear actuator operably coupled to the first track, said second linear actuator including a linearly moveable element and a manual control, manipulation of the manual control causing linear movement of the linearly moveably element and the first track with the saw assembly along the second track, said second linear actuator comprising a chain drive, said chain drive comprising a chain trained around a drive cog and a driven cog and having a substantially straight segment extending between the drive cog and the driven cog, said straight segment of the chain being coupled to the first track, a shaft extending from the drive cog and a handle on the shaft, said straight segment of the chain comprising the linearly moveable element of the second linear actuator, and said handle comprising the manual control of the second linear actuator, each of said drive cog and said driven cog being rotatably coupled to the second track, rotation of the manual control in a first rotational direction causing rotation of the drive cog, movement of the chain and linear motion of the first track along the second track in the first direction of linear motion; and said saw assembly further comprising a shroud substantially surrounding the peripheral cutting teeth of the saw blade, said shroud including a vacuum port coupled to a vacuum hose coupled to a vacuum for debris collection and a shield vertically movable relative to the shroud under the influence of contact with the walkway, said shield including a shield portion having a plurality of elongated vertical slots, each vertical slot defining an upper shield position and a lower shield position, and said shroud including a shield attachment for each of the plurality of elongated vertical slots, each shield attachment allowing vertical movement of the shield portion relative to the shield attachment between the upper shield position and the lower shield position.

2. The walkway surface cutting system according to claim 1, further comprising a utility vehicle and a hinge coupling the front of the gantry to the utility vehicle, said gantry being pivotable about the hinge from a deployed position to a stowed position.

3. The walkway surface cutting system according to claim 2, a hoisting apparatus coupled to the utility vehicle and gantry and pivoting the gantry between the deployed position and the stowed position.

4. The walkway surface cutting system according to claim 3, the hoisting apparatus comprising a winch attached to the utility vehicle and a tether extending from the winch to the gantry.

5. The walkway surface cutting system according to claim 4, the tether comprising a cable, the cable having a distal end attached to the gantry, and the winch including a spool and the cable including a wound portion on the spool.

6. The walkway surface cutting system according to claim 1, the motor of the saw assembly comprising a hydraulic motor.

7. The walkway surface cutting system according to claim 6, further comprising a hydraulic pump supplying hydraulic fluid to the hydraulic motor.

8. The walkway surface cutting system according to claim 1, the first linear actuator comprising a pneumatic actuator.

9. The walkway surface cutting system according to claim 8, further comprising a control valve pneumatically coupled to the first linear actuator, said control valve controlling a flow of compressed air to the linear actuator.

10. The walkway surface cutting system according to claim 9, further comprising an air compressor supplying a flow of compressed air to the first linear actuator through the control valve.

* * * * *